US009663974B2

(12) United States Patent
Savage et al.

(10) Patent No.: US 9,663,974 B2
(45) Date of Patent: May 30, 2017

(54) FRONT-MOUNTED DOOR ASSEMBLY FOR STORAGE AND DISPENSING UNITS

(71) Applicant: Apex Industrial Technologies LLC, Mason, OH (US)

(72) Inventors: Benjamin V. Savage, Loveland, OH (US); Craig S. Whitaker, Fairfield, OH (US); John Hooten, Cincinnati, OH (US)

( * ) Notice: Subject to any disclaimer, the term of this patent is extended or adjusted under 35 U.S.C. 154(b) by 52 days.

(21) Appl. No.: 14/466,040

(22) Filed: Aug. 22, 2014

(65) Prior Publication Data

US 2016/0053514 A1 Feb. 25, 2016

(51) Int. Cl.
*E05B 65/02* (2006.01)
*E05B 65/00* (2006.01)
(Continued)

(52) U.S. Cl.
CPC ..... *E05B 65/025* (2013.01); *E05B 47/0004* (2013.01); *E05B 47/0603* (2013.01); *E05B 65/0003* (2013.01); *E05G 1/04* (2013.01); *E05G 1/08* (2013.01); *E05B 65/44* (2013.01); *E05B 2047/0048* (2013.01);
(Continued)

(58) Field of Classification Search
CPC .. E05B 47/00; E05B 47/0001; E05B 47/0046; E05B 47/06; E05B 47/0603; E05B 2047/0048; E05B 2047/005; E05B 2047/0051; E05B 2047/0052; E05B 2047/0067; E05B 2047/0068; E05B 2047/0069; E05B 2047/0073; E05B 2047/0076; E05B 65/00; E05B 65/0003; E05B 65/006; E05B 65/02; E05B 65/025;
(Continued)

(56) References Cited

U.S. PATENT DOCUMENTS 4,494,805 A * 1/1985 Washburn ..... E05B 47/0002 200/318
5,172,970 A * 12/1992 Momose ..... E05B 47/0002 292/201
(Continued)

FOREIGN PATENT DOCUMENTS

EP 2138070 12/2009

OTHER PUBLICATIONS

PCT, International Search Report and Written Opinion, PCT/US2015/046012 (Nov. 13, 2015).

*Primary Examiner* — Christopher Boswell
(74) *Attorney, Agent, or Firm* — Thompson Hine LLP

(57) ABSTRACT

A storage assembly including a frame at least partially defining a plurality of storage compartments that are accessible from a front of the storage assembly. The assembly further includes a plurality of doors, each door being associated with at least one storage compartment and movable between a closed position in which the door generally prevents access to the associated storage compartment and an open position in which the door allows access to the associated storage compartment. The assembly further includes a plurality of accessory components. Each accessory component is operatively associated with at least one of the doors, and each accessory component is operatively coupled to a controller via control wiring. The storage assembly includes a front-facing channel in which the control wiring is at least partially positioned.

17 Claims, 14 Drawing Sheets

(51) Int. Cl.

| | |
|---|---|
| ***E05B 47/06*** | (2006.01) |
| ***E05G 1/04*** | (2006.01) |
| ***E05G 1/08*** | (2006.01) |
| *E05F 15/611* | (2015.01) |
| *E05F 15/603* | (2015.01) |
| *E05B 47/00* | (2006.01) |
| *E05B 65/44* | (2006.01) |

(52) U.S. Cl.
CPC ..... *E05B 2047/0072* (2013.01); *E05F 15/603* (2015.01); *E05F 15/611* (2015.01)

(58) Field of Classification Search
CPC ..... E05B 65/44; E05B 65/46; E05B 65/462; E05B 65/52
See application file for complete search history.

(56) References Cited

U.S. PATENT DOCUMENTS 5,225,825 A * 7/1993 Warren ..... E05B 65/462 221/125
5,346,297 A * 9/1994 Colson, Jr. ..... E05B 47/023 312/215
5,504,325 A * 4/1996 Talmon ..... G07F 17/12 109/56
6,682,156 B2 * 1/2004 Herrington ..... E05B 65/462 250/221
6,685,284 B2 * 2/2004 Hara ..... A47G 29/141 312/215
7,052,097 B2 * 5/2006 Meek, Jr. ..... E05B 47/0002 312/209
7,868,578 B2 * 1/2011 Scheffknecht ..... E05B 17/0029 318/466
8,197,017 B2 * 6/2012 Rahilly ..... E05B 65/0003 312/215
8,246,124 B2 * 8/2012 Mackillop ..... E05B 65/025 232/25
9,045,923 B2 * 6/2015 Krawczyk ..... E05B 47/02
2005/0179349 A1 8/2005 Booth et al.
2006/0255116 A1 * 11/2006 Yong ..... A47G 29/1201 232/24
2010/0223857 A1 9/2010 Sutton et al.
2012/0086314 A1 4/2012 Bourke et al.
2012/0200213 A1 8/2012 Savage et al.

* cited by examiner 10
116
180
22

UP
114'
180
115A
14
114'
180
115A
116
UP
114'
180
115A
14
114'
180
115A
116

FRONT-MOUNTED DOOR ASSEMBLY FOR STORAGE AND DISPENSING UNITS

The present application is directed to a door assembly for storage and dispensing units and, more particularly, to a door assembly which enables a simplified installation of doors and accessory components.

BACKGROUND

Storage and dispensing units often include a plurality of internal compartments, such as in a multi-tiered locker-like configuration. The units also typically include a plurality of individual doors or the like to control access to these internal compartments. The number, size and/or arrangement of the internal compartments may vary, which can require different door configurations.

The units may also require the installation of accessory components that cooperate with, or operate in conjunction with, the doors, such as locks, door position sensors, indicator lights, etc. In some existing storage and dispensing units, accessory components have been individually mounted to the structural frame and then individually wired to a controller unit housed within the storage and dispensing unit. However, and particularly in the case of units with differently-sized internal compartments, installing the accessory components and routing the associated wiring through the unit can be a complex, time-consuming, and costly process because the wiring is generally routed behind a front frame and internally between the walls of the internal compartments. In addition, individually mounting the accessory components slows the manufacturing and assembly process, since only a limited number of workers may have access to the front frame of the unit at any given time.

SUMMARY

In one embodiment, the invention is a storage assembly including a frame at least partially defining a plurality of storage compartments that are accessible from a front of the storage assembly. The assembly further includes a plurality of doors, each door being associated with at least one storage compartment and movable between a closed position in which the door generally prevents access to the associated storage compartment and an open position in which the door allows access to the associated storage compartment. The assembly further includes a plurality of accessory components. Each accessory component is operatively associated with at least one of the doors, and each accessory component is operatively coupled to a controller via control wiring. The storage assembly includes a front-facing channel in which the control wiring is at least partially positioned.

BRIEF DESCRIPTION OF THE DRAWINGS

FIG. 2A is an exploded front perspective view of a storage or dispensing unit;

DETAILED DESCRIPTION

Figure 1:
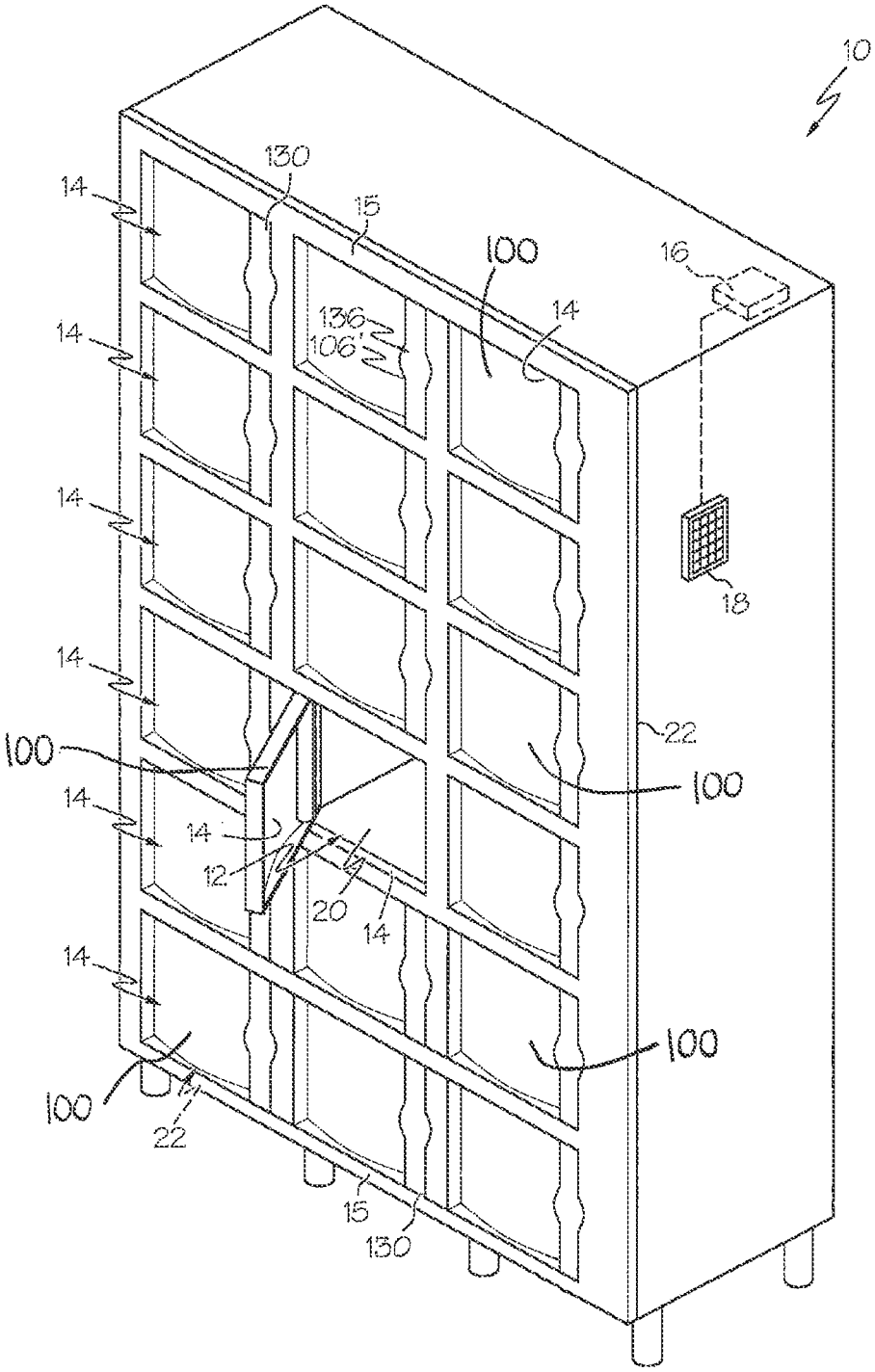
FIG. 1 is a front perspective view of one embodiment of a storage or dispensing unit.
Figure 24:
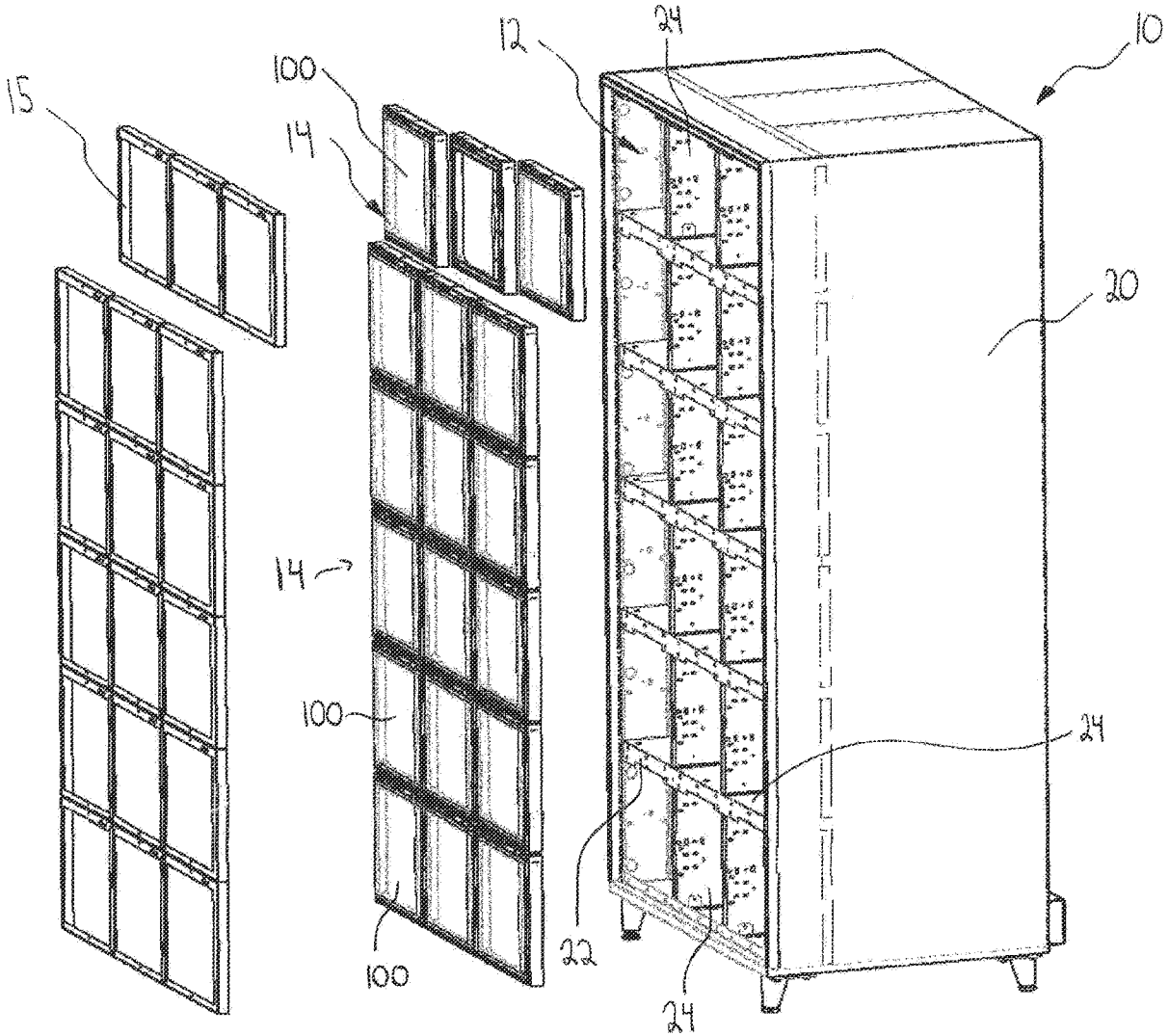

FIG. 1 illustrates a storage or dispensing unit, or storage assembly 10, which may be used to store, display, and/or dispense various products. In one embodiment, the storage assembly 10 includes a plurality of internal compartments 12, each compartment 12 having an associated door 100, which can be coupled to and/or be part of an associated door assembly 14. Each door 100 may be movable (pivotally movable, in one embodiment) to and from a closed position in which the door 100 generally, or entirely, covers the associated opening and prevents access to the associated internal compartment 12, i.e., prevents manual access thereto. Each door 100 may also be movable to and from an open position in which the door 100 does not prevent access, or allows manual access to the associated internal compartment 12. In one case each door 100 is manually movable between the open and closed position, but the doors 100 may be automatically moved in some cases if desired.

The storage assembly 10 may include or be coupled to a controller 16 that selectively controls access to the internal compartments 12 by operatively controlling the opening and/or closing and/or locking and/or unlocking of one more individual doors 100. The controller 16 may include or take the form of a programmable microcontroller, a microprocessor and associated memory, a so-called embedded computer, or the like. The controller 16 may be operatively connected to a user interface 18, which can take any of a wide variety of forms, including but not limited to a keypad, keyboard, card reader (i.e., magnetic, optical, or smart card reader), a biometric reader (i.e., fingerprint, voice, or iris reader), an RF or optical receiver (including an RFID transceiver), a touch screen, or a display. The controller 16 may include an associated pointing or selection device such as a mouse, trackball, joystick, pointing stick, or the like.

Each door assembly 14/door 100 may default to a locked or secured state, in which pivoting motion is prevented, and be able to be unlocked or unsecured to permit access to the associated internal compartment 12, then locked or secured to prevent access to the associated compartment 12, in response to signals provided from the user interface 18 and/or controller 16. For example, in one case the storage assembly 10, controller 16, and/or user interface 18 may include an auditing/identification system and/or authentication system for determining or confirming the identity of a user. The user may be identified/authenticated through various means or devices, such as by a user-entered PIN, ID, and/or password, a key fob or other wireless communications device that can emit an optical or radio frequency code, a mechanical, electronic, or optical key (the latter including, e.g., bar codes, QR codes, or other optical coding schemes), a magnetic strip-encoded card, a smart card, biometric information as outlined above, or others.

In this manner properly identified, authorized users may be provided access to one or more internal compartments 12 by the controller 16, such as by unlocking and/or opening the associated door assemblies 14/doors 100 to enable the user to access parts, tools, consumables, or other items positioned in the compartments 12 of the storage assembly 10. However, it should be understood that the systems, concepts, methods and devices disclosed herein are not necessary limited to use with storage assemblies 10 which require identification, authentication, or access restriction.

In some cases the storage assembly 10 may be positioned in the facility of a working environment, and the user may be a worker at the facility. In this case the storage assembly 10 may be stocked with goods which a worker may use to carry out his or her work duties. In this case (as well as in other cases) the storage assembly 10 may track various storage and/or dispensing information, such as which user has accessed which internal compartment 12, the timing of such access, details of the user's activity, the amount and cost of inventory, storage time for the inventory etc., and generate dispensing activity and inventory reports. The storage assembly 10 may also control and restrict access to all or certain of the internal compartments 12 based upon the authorization level(s) of the user, the timing of the access (i.e., may restrict access to working hours), etc. However the storage assembly 10 may also be used in other settings, such as in commercial use as a vending machine or the like, in which case the storage assembly 10 may be able to process payment from a user, such as via a credit card or other payment methods, via the controller 16.

Figure 2B:
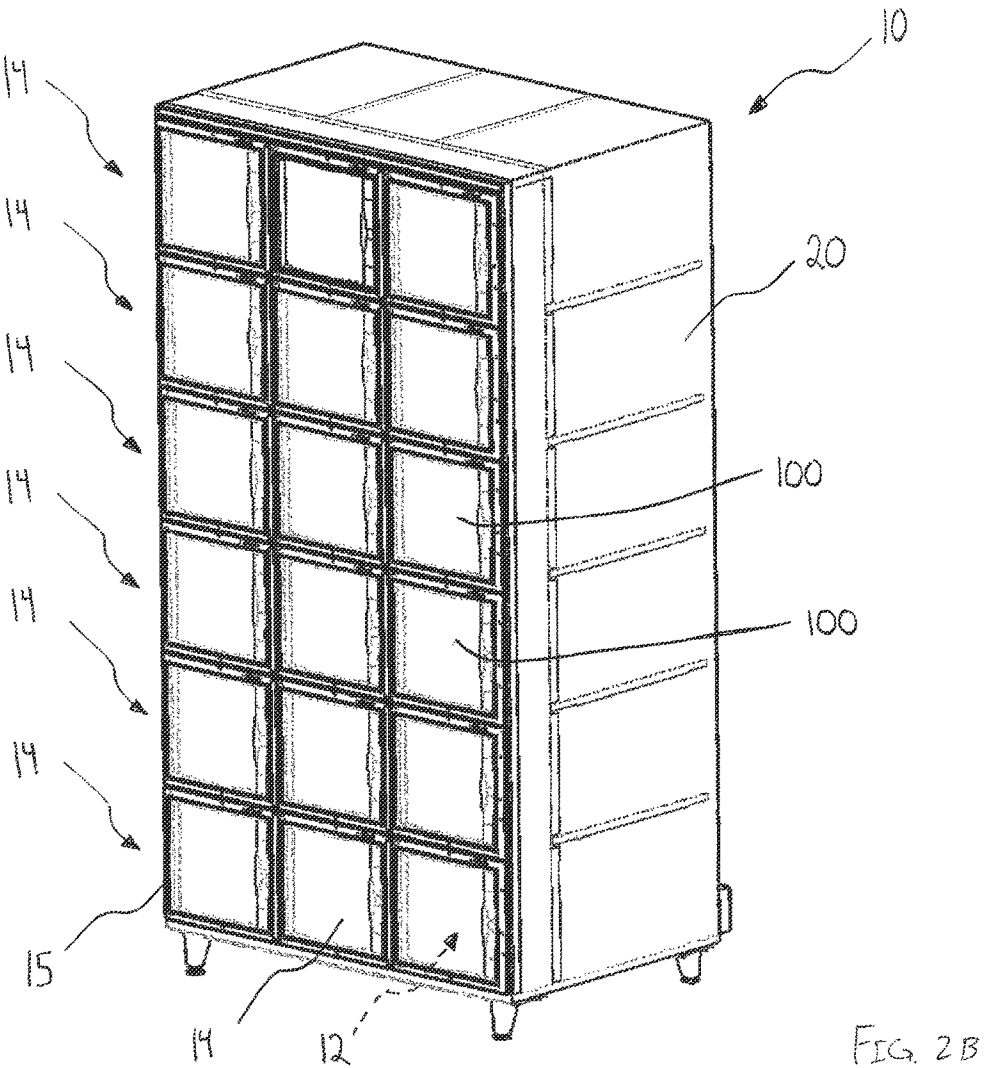
FIG. 2B is the storage or dispensing unit of FIG. 2A, shown in an assembled configuration.

As shown in FIGS. 2A and 2B, the storage assembly 10 may include a structural frame 20 having a front frame portion 22 positioned at or adjacent to the open end of the internal compartments 12. The structural frame 20 and/or front frame portion 22 may include one or more vertically and/or horizontally-positioned partitions 24 which divide the interior of the storage assembly 10 into internal compartments 12 of equal or unequal size. It will be apparent from the figures that an additional partition 24 may be positioned within an internal compartment 12 defined by the structural frame 20 to define two "half-size" internal compartments (see FIG. 3A), or that a partition 24 could be removed/omitted from the structural frame 20 to create a "double-sized" internal compartment 12, depending upon the frame of reference. It will be appreciated that compartments 12 of other proportions, i.e., "third-sized", "two-thirds-sized," "single-sized," "double sized," and "triple-sized," etc. may also be provided, depending upon the use and placement of the partitions 24.

Figure 3A:
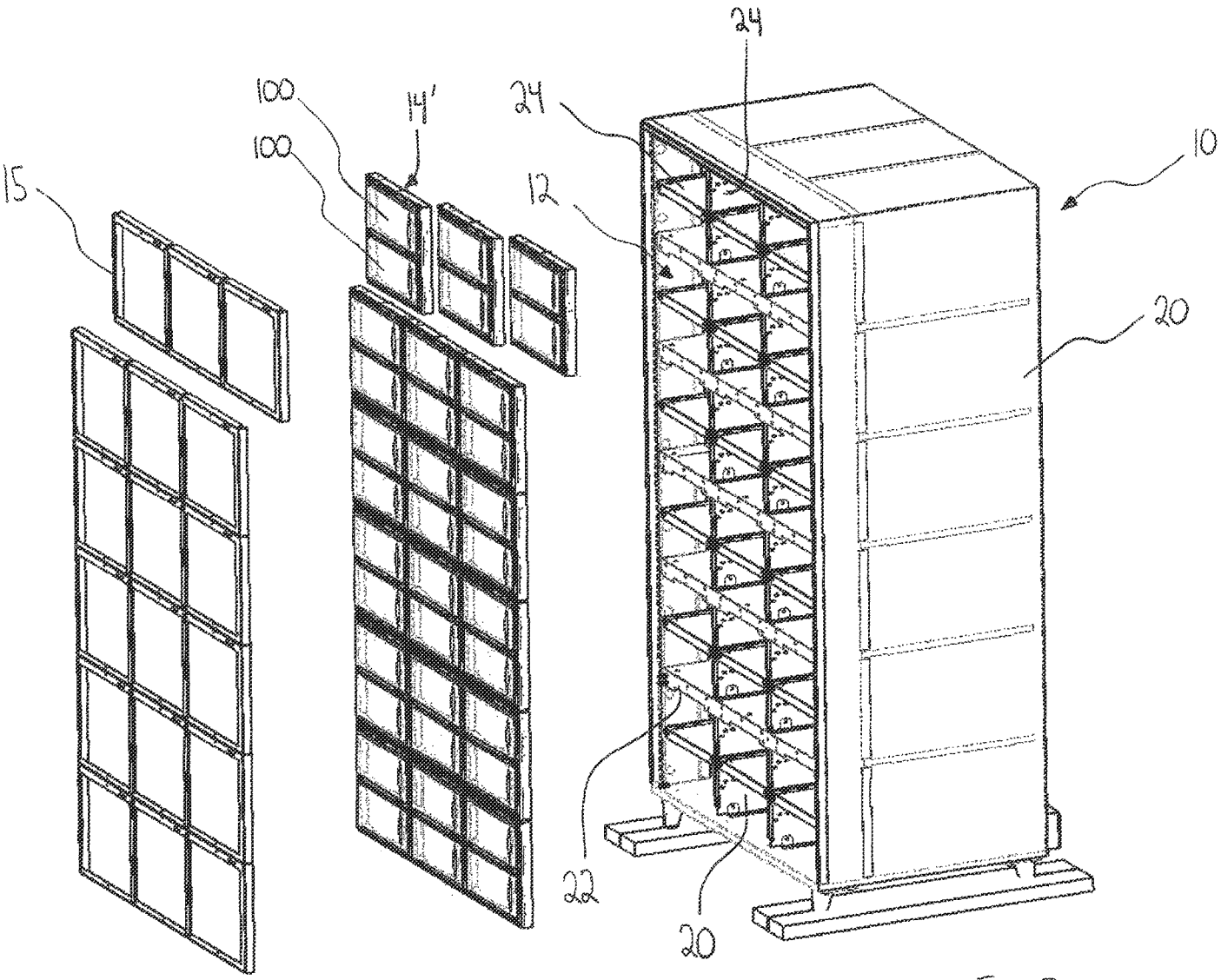
FIG. 3A is an exploded front perspective view of another storage or dispensing unit.
Figure 3B:
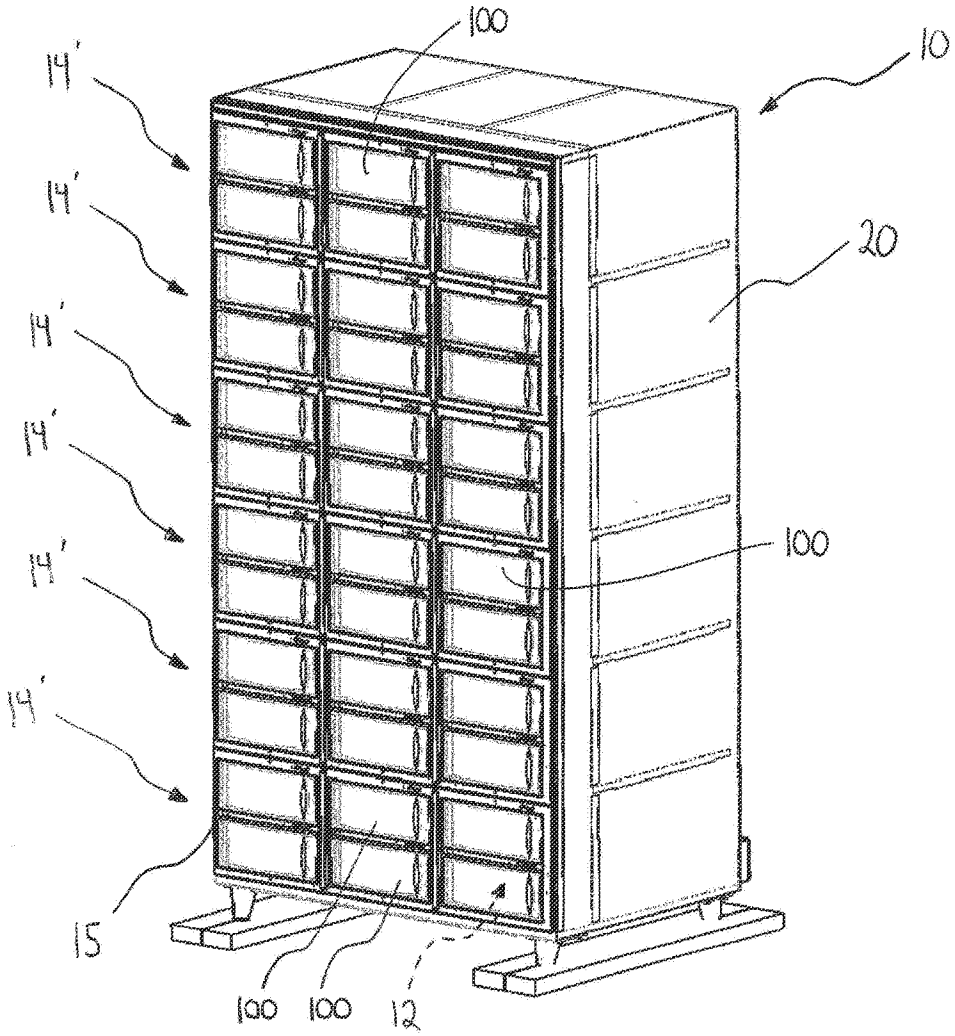
FIG. 3B is the storage or dispensing unit of FIG. 3A, shown in an assembled configuration.

Different combinations of differently-sized compartments 12 may be defined within the same storage assembly 10 in order to store or display different items having different sizes. Thus, it can be seen that differently configured door assemblies 14 may be needed. For example, in the simplest configuration each door assembly 14 has a single door 100 that matches the size and shape of a single internal compartment 12, as shown by the upper three door assemblies 14 in FIG. 2A. Alternately, some or all door assemblies 14 may include more than one door 100, each of which covers a single internal compartment 12, as shown by the upper three door assemblies 14 in FIG. 3A. FIG. 3A illustrates an embodiment in which a door assembly 14' includes two, vertically spaced doors 100, each door 100 covering a single associated compartment 12. It will be appreciated that other door assemblies 14' may include three or more vertically spaced doors 100 covering associated compartments, a plurality of horizontally spaced doors 100 covering associated compartments, a two-dimensional array of vertically and horizontally spaced doors 100 covering associated compartments, etc.

As will be described in greater detail below, the door assemblies 14 may be modularly coupled to the structural frame 20. The door assemblies 14, after being mounted to the structural frame 20, may be covered by a fascia 15 (or multiple fascias), as will be described in greater detail below. As illustrated in FIGS. 2A, 2B, 3A, and 3B, a single fascia 15 may cover only a single door assembly 14 or part thereof, or a single fascia 15 may cover multiple door assemblies 14.

Figure 4:
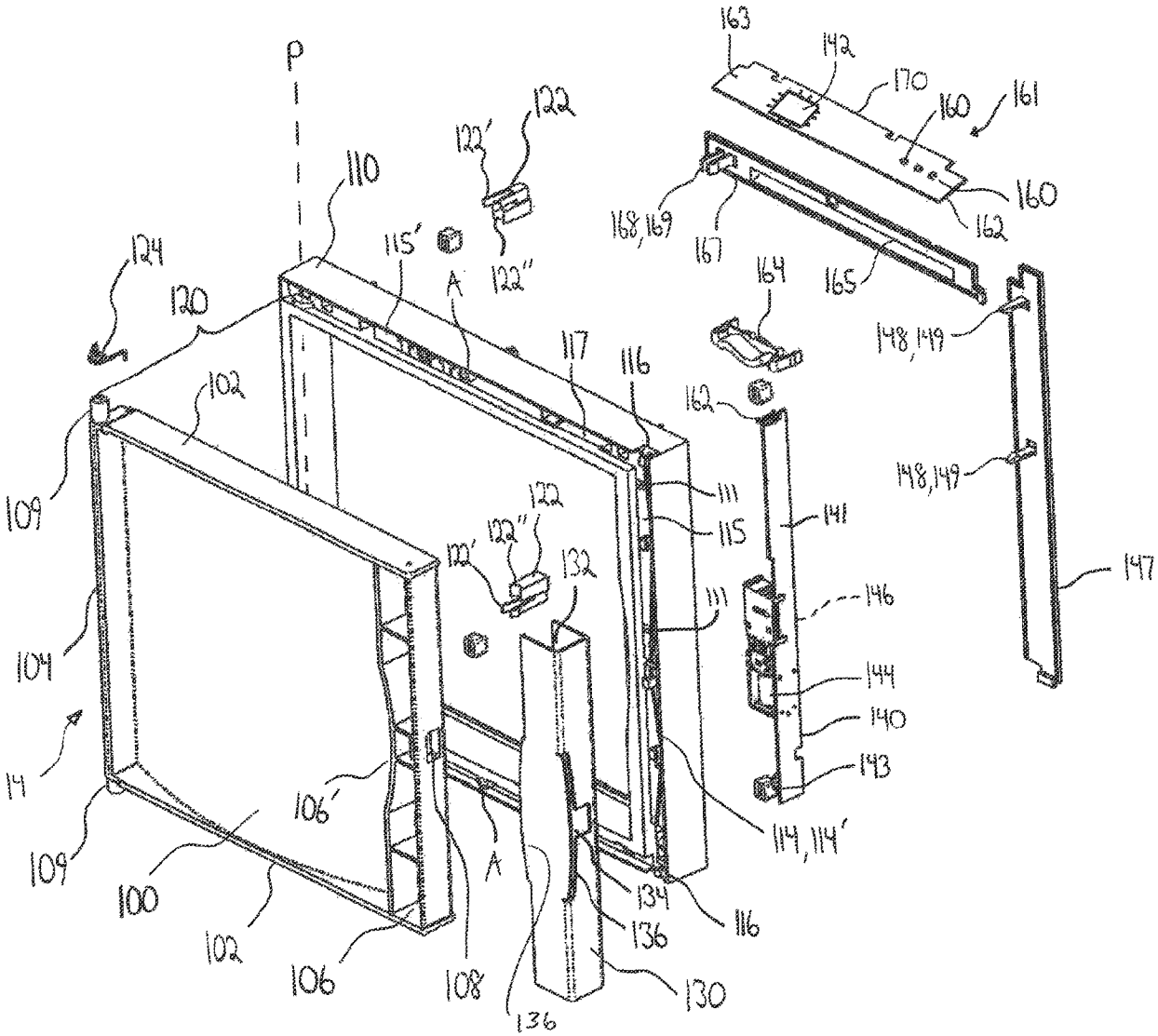
FIG. 4 is an exploded front perspective view of a door assembly.
Figure 5:
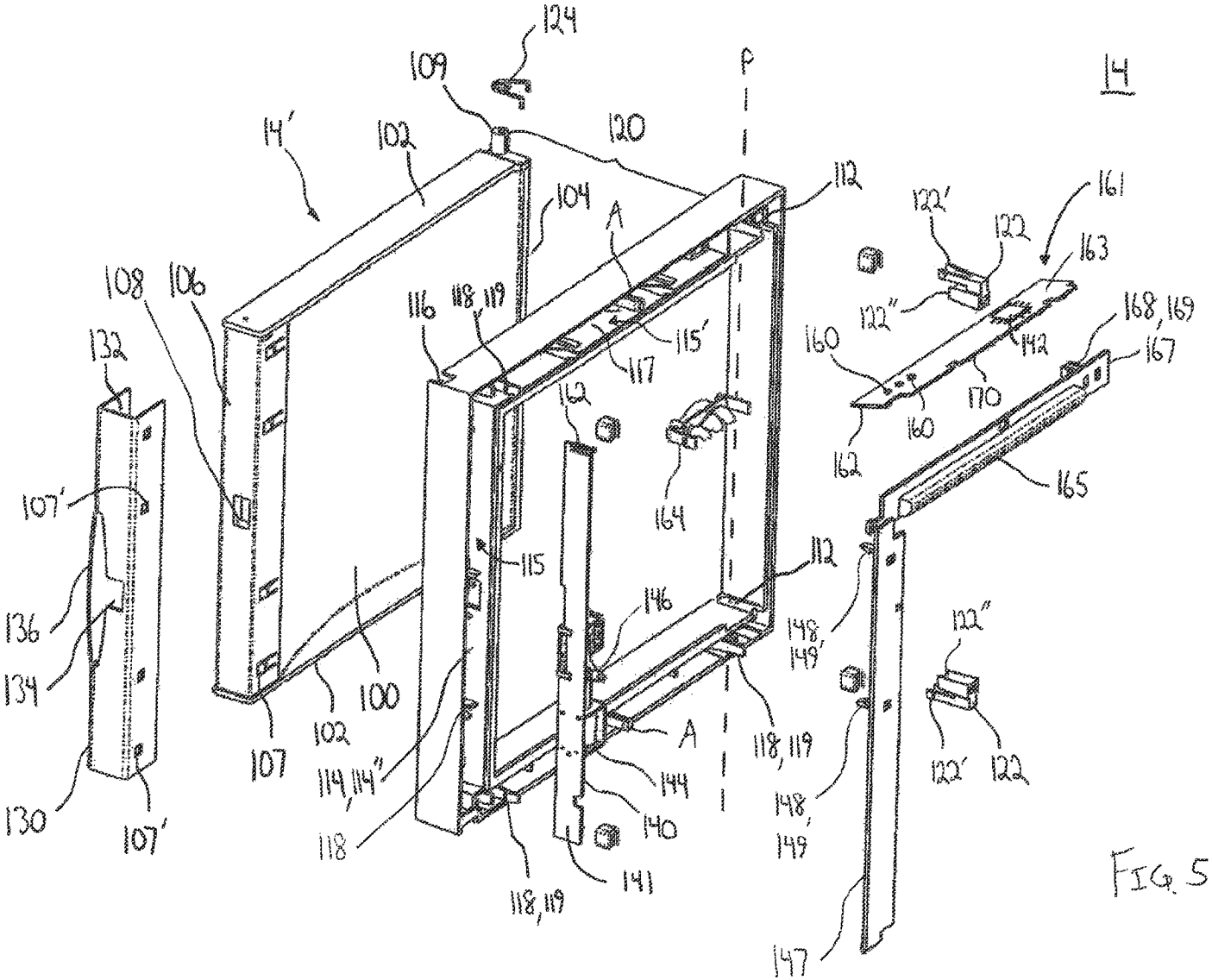
FIG. 5 is an exploded rear perspective view of the door assembly of FIG. 4.

FIGS. 4 and 5 illustrate a first embodiment of a front-mounted door assembly 14 having a door 100 and a door frame 110 extending about the perimeter of the door 100. The door assembly 14 further includes a pivoting connection 120 between the proximal end of the door 100 and the door frame 110 such that the door 100 is pivotable about a pivot axis P. The door assembly 14 may further include a reinforcing handle 130 positioned at an opposite, distal end of the door 100 relative to the pivoting connection 120.

The door 100 can be made of various materials, and in one embodiment is generally transparent to enable visual inspection of the internal compartment 12 and/or items stored therein. Alternately, the door 100 may be generally translucent or opaque to provide greater security or privacy. Further alternately, differing parts of the door 100 may be transparent, translucent and/or transparent as desired by the owner/operator. The door 100 in one case is made of a resilient material such as plastic, formed by injection molding, thick-gauge thermoforming, or other techniques.

The door 100 may optionally include stiffening strips 102, 104 positioned along all or part of the outer perimeter thereof. For example, in the illustrated embodiment the door 100 includes stiffening strips 102 along the upper and lower edges thereof between the pivoting connection 120 and the reinforcing handle 130. The illustrated door 100 also includes a stiffening strip 104 affixed along the proximal (and, optionally, distal) vertical edge of the door 100 adjacent and parallel to the pivoting axis P. If utilized, the stiffening strips 102, 104 may be integrally formed with the door 100 from the same materials as the door 100 itself. Alternately, the strips 102, 104 may be separate components affixed to the door 100, and comprised of different materials than that of the door 100, such as metal or fiber-reinforced plastic.

The door 100 may further include a handle mount 106 at its distal end which includes integrated ribs and additional structure in order to provide stiffness to the door 100. The handle mount 106 is configured to receive a reinforcing handle 130 thereon. In one embodiment, the reinforcing handle 130 has a plurality of apertures 107' (FIG. 5) and the handle mount 106 has a plurality of deformable/elastic fingers 107 carrying triangular ramps adapted to lockingly engage within the plurality of apertures 107' to couple the handle 130 to the handle mount 106. If desired, the positions of the apertures 107' and fingers 107 may be reversed such that the apertures 107' are positioned on the handle mount 106 and the fingers 107 are positioned on the reinforcing handle 130. In addition, the reinforced handle 130 may be coupled to the handle mount 106 by any of a variety of other means or mechanisms, such as adhesives, fasteners, thermal welding, etc.

The handle mount 106 may include a lock aperture 108 for receiving a locking projection 146 of a locking mechanism 140 to lock the door 100, as will be described in greater detail below. The reinforcing handle 130 may correspondingly include a lock aperture 134 aligned with the lock aperture 108 of the handle mount 106 to enable the locking projection 146 to extend therethrough. The structure surrounding the lock aperture 134 defined by the reinforcing handle 130 can be made of a particularly strong material, as outlined above, so provide greater strength and security and retain the locking projection 146 therein. The handle mount 106 may also have a recessed, arcuately profiled internal portion 106' (FIG. 4), including a concave surface facing the proximal end of the door 100 (adjacent the pivot axis P). The internal portion 106' provides a recess to aid a user handling the door 100, as described in greater detail below.

The reinforcing handle 130 can be made of a variety of materials, such as metal, fiber-reinforced polymers/plastic, other polymers, etc., or as plastic-overmolded material or the like of sufficient strength to provide stiffness (resist torquing or twisting forces) and resist forced openings of the door 100 and/or locking mechanism 140. The reinforcing handle 130 may in some cases be substantially opaque to obscure the configuration and operation of the locking mechanism 140, which may be positioned behind/aligned with the reinforcing handle. The reinforcing handle 130 may be formed in the shape of a C-shaped channel 132 for receiving the handle mount 106 therein.

The reinforcing handle 130 may include a pair of generally flat, oppositely extending projections 136 on its front surface. In the illustrated embodiment the projections 136 have arcuate outer surfaces and one of the projections 136 shields the lock aperture 134, i.e., projects outward from the distal end of handle 130 in the immediate vicinity of the lock aperture 134. This projection 136 extends over and obscures visibility of, and limits access to, the locking mechanism 140 by covering the seam between the distal end of the door 100 and the door frame 110. The other projection 136 cooperates with the concave internal portion 106' to provide a handle recess between a front face of the door 100 and the rear face of the handle 130, which can receive a user's hand therein to open and/or close the door 100.

The pivoting connection 120 between the door 100 and door frame 110 may include or take the form of a pair of oppositely projecting pivots 109 positioned at the upper and lower edges of the door 100. Each pivot 109 may be received in a corresponding slot 112 formed in upper and lower edges of the door frame 110. In one exemplary construction, the pivots 109 take the form of bosses projecting from the upper and lower edges of the door 100, or the stiffening strips 102, 104, where present. In another exemplary construction, the pivots 109 take the form of pins mounted to the door 100 at the upper and lower edges of the door 100. If desired, the positions of the pivots 109 and slots 112 may be reversed such that the pivots 109 are positioned on the door frame 110 and the slots 112 are positioned on the door 100.

The pivots 109 may be secured within slots 112 by snap-fit clips 122. Each clip 122 may include a pair of elastic fingers 122' carrying triangular ramps adapted to lockingly engage within an aperture 113 (visible in FIG. 8) in the door frame 110 adjacent a closed end of the slot 112. Each clip 122 may include a curved abutment surface 122" configured to abut a circumferential portion of the pivot 109 to properly locate the clip 122 and guide the pivoting motion of the pivot 109. Thus, the pivots 109 may be locked into position within the slots 112 between the door frame 110 and the clips 122. In one embodiment, each pivot 109 may include a circumferential groove, and each clip 122 may include an arcuate projection adapted to fit around and/or within the groove to secure the pivot 109 and prevent non-rotational (i.e., axial) movement of the pivot 109 within the slot 112. Limiting axial movement of the door 100 helps to provide a more secure mounting arrangement, and can reduce or minimize tampering to secure unauthorized access.

The pivoting connection 120 may include one or more springs 124 configured to bias the door 100 toward an open or a closed position with respect to the door frame 110. In one example, the springs 124 bias the door 100 toward an open position in order to signal to a user that the door 100 has been unlocked/unsecured and/or to require the user to positively secure the door 100. Alternately, the springs 124 may bias the door 100 toward a closed position in order to allow the door 100 to be automatically locked/resecured after it has been opened. In one embodiment, the springs 124 may be torsion springs seated around or adjacent to the pivots 109 and/or pivot axis P. The springs 124 may engage adjacent portions of the door 100 and the door frame 110 or clip 112 to bias the door 100 toward the open or closed position.

The door frame 110 can be made of a variety of materials, including metal or other resilient material such as fiber reinforced plastic or plastic/polymer which can be manufactured by injection molding. The door frame 110 may include the slots 112 (and/or pivots 109) as outlined above to provide the pivoting connection 120. The door frame 110 may also include a front-facing channel 114 extending about all, or part, of the perimeter thereof. In the illustrated embodiment the front-facing channel 114 extends vertically across the distal end of the door frame 110. At least part of each front-facing channel 114 may be open to the front of the storage assembly 10, that is, open to the side of the storage assembly 10 at which a user is positioned when accessing an internal compartment 12, or the side to which the compartment 12 is open. The front-facing channel 114 may also include, or be in communication with, a pair of front-facing slots 116 positioned on opposite ends (vertical ends, in the illustrated embodiment) of the front-facing channel 114.

Figure 7:
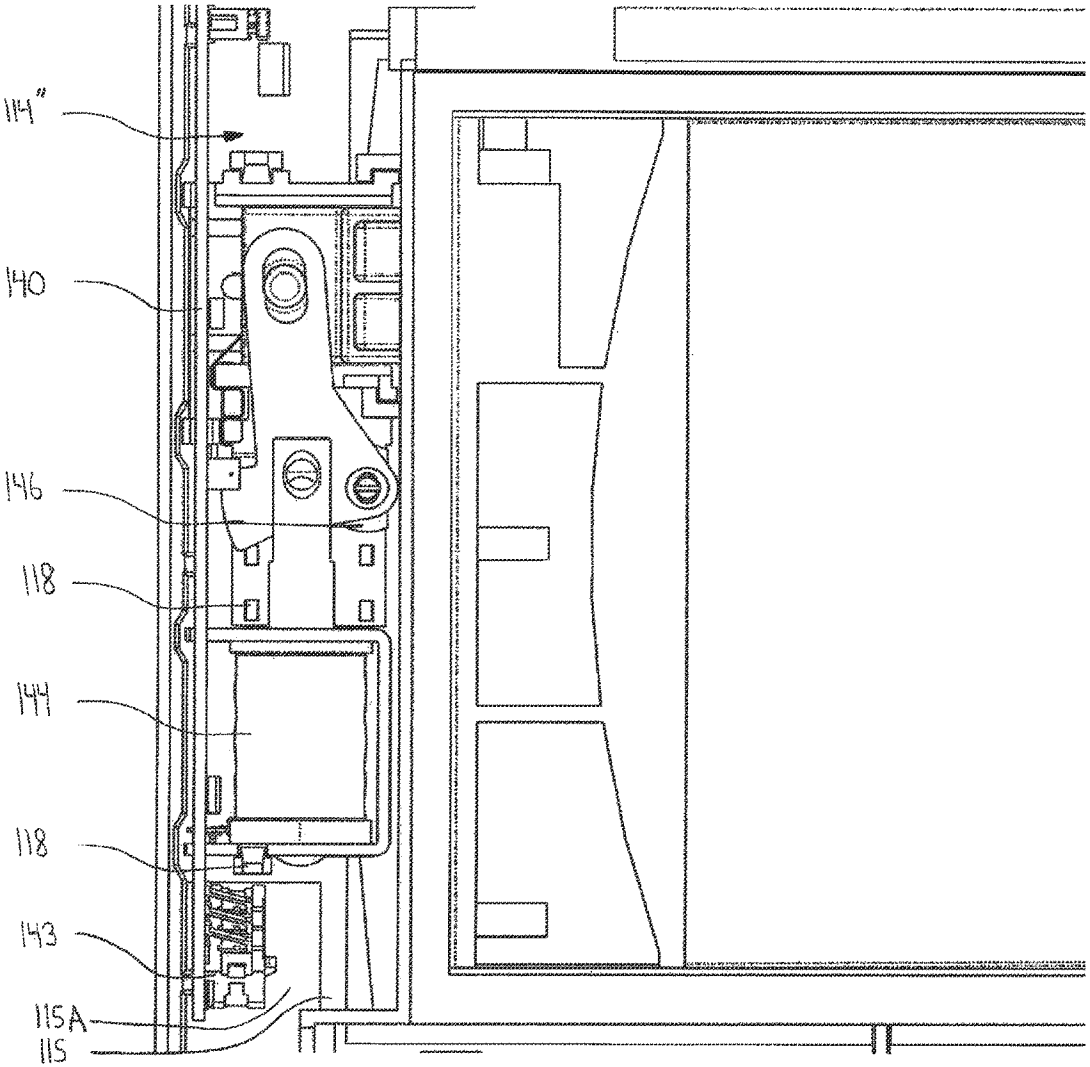
FIG. 7 is a rear view of a locking mechanism of a door assembly.

Each front-facing slot 116 may include an opening or cut-out formed in the door frame 110 to provide access to a front-facing channel 114 of another door frame 110 positioned thereabove or therebelow. In this manner each front-facing channel 114 may be in communication with a front-facing slot 116 and/or channel 114 of a door frame 110 located above/below the door frame 110, as appropriate. The front-facing channel 114 may be open to both the front and the back, but in one case may include an intermediate web 115 substantially dividing the channel 114 into a front-facing, three-sided channel portion 114' (FIG. 4) and a rear-facing three-sided channel portion 114" (FIG. 5). When included, the intermediate web 115 may include at least one aperture 115A (FIGS. 7 and 8) to provide access from the front-facing channel portion 114' to the rear-facing channel portion 114".

In one embodiment, the front-facing channel 114 may include a channel extension 117 extending horizontally along the door frame 110 from the distal end of the door 100 toward the proximal end of the door and pivot axis P, running generally perpendicular to the vertically extending portion of the front-facing channel 114. The channel extension 117 may include a corresponding intermediate web extension 115' and a corresponding aperture. The illustrated channel extension 117 extends along the top of the door 100/door frame 110, but could also, or instead, extend along the bottom of the door 100/door frame 110.

The door frame 110 may be adapted to be mounted to the front frame 22 of a storage assembly 10. As shown in FIG. 5, in one embodiment the door frame 110 may include a plurality of elastically deformable fingers 118 carrying triangular ramps 119 adapted to lockingly engage a plurality of apertures 26 (FIG. 6) on the front frame 22 of the storage assembly 10. The door assembly 14 may thus be affixed to the structural frame 20 through a form of snap-fit engagement. The door frame 110 may alternately or in addition include a plurality of apertures A about its outer perimeter adapted to receive fasteners, such as a screws or the like, therethrough and into engagement with the plurality of apertures 26 of the front frame 22.

As will be described in greater detail below, a variety of accessory components, such as lights 160, 170, door state sensors 150 (or other sensors), locking mechanisms 140, door controller 142 and the like may be coupled to the door frame 110/door assembly 14. In this case each door assembly 14 may be manufactured/assembled by itself, separate and apart from the structural frame 20, with all of the accessory components secured thereto. The door assembly 14 may then be quickly and easily mechanically attached to the structural frame via the fingers 118 or the like. In addition, the control wiring 180 associated with the door assembly accessory components may be easily attached to each door assembly 14 by a simple connector or plug. For example, one or more accessory components may include a header and the control wiring may include a corresponding connector, such as a so-called Micro-Fit™ connector (Molex, Inc., Lisle, Ill., USA). The control wiring 180 may comprise a shared bus which is routed through the front-facing channels 114 of the door assemblies 14 and connected to each door assembly after the door assemblies 14 are affixed to the front frame 22/structural frame 20. In this manner each door assembly 14 provides a modular unit which can be easily coupled to, and uncoupled from the structural frame 20 with simple mechanical and electronic connections. For example, each accessory component may be directly coupled to the associated door assembly 14, and not directly coupled to the structural frame 20. The modular connection/assembly provides ease of manufacture, as well as replacement and repair.

Figure 8:
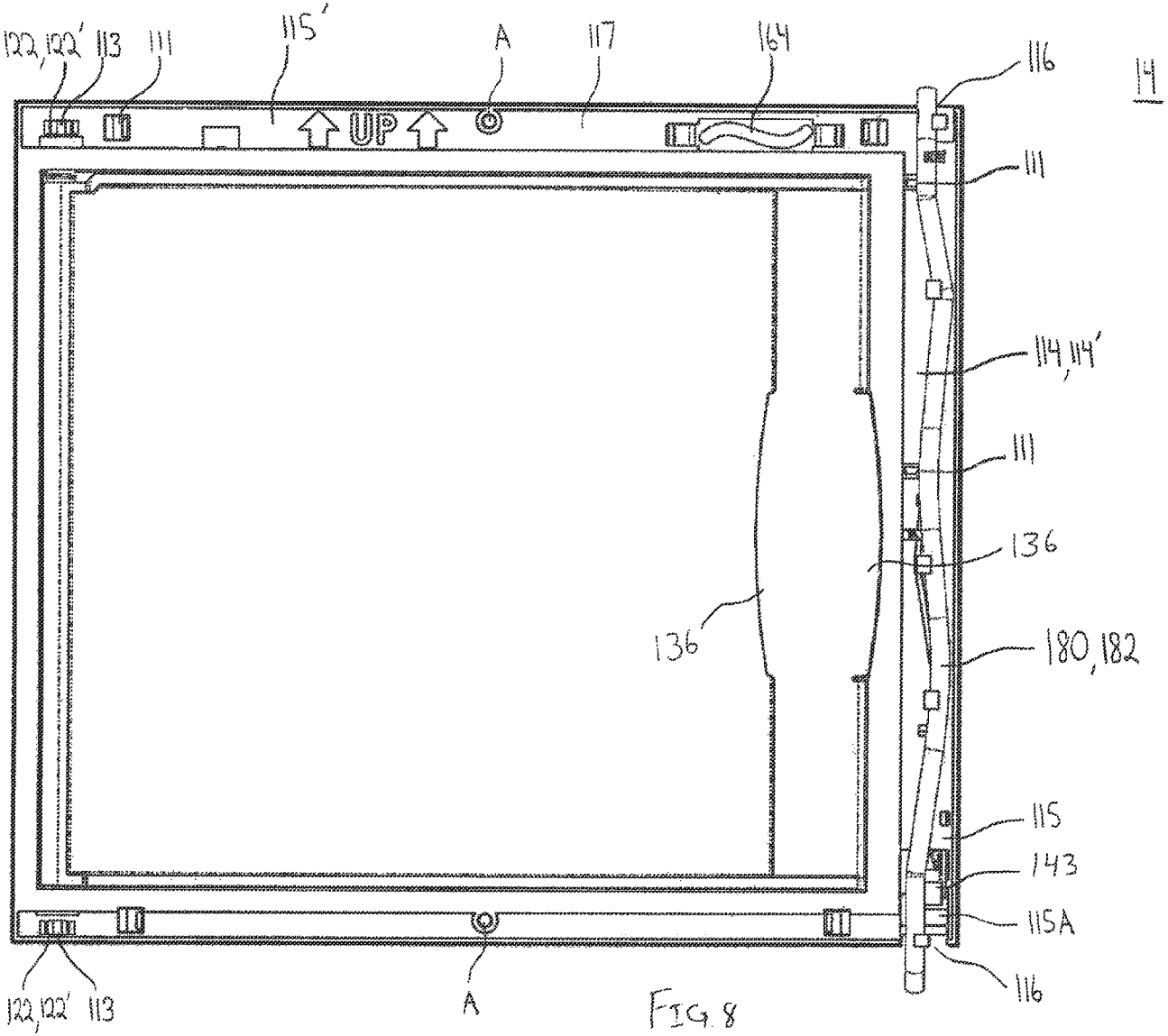
FIG. 8 is a front view of a door assembly, with the fascia removed, showing control wiring routed across the front of the door assembly.

With reference to FIGS. 4, 5 and 8, the front-facing channel 114 may be configured to receive and retain the locking mechanism 140. The locking mechanism 140 may include a daughterboard 141 bearing a solenoid 144 and a locking projection 146. The locking mechanism 140 may also include the door controller 142, i.e., a microcontroller 142 operably controlling the solenoid 144 to in turn control the extended or retracted (locked or unlocked) position of the locking projection 146, and a communications header 143. Those of skill will appreciate that the microcontroller 142 and communications header 143 need not be physically integrated with the locking mechanism 140, but merely provided on one of the accessory components and electrically interconnected with the locking mechanism 140.

Figure 6:
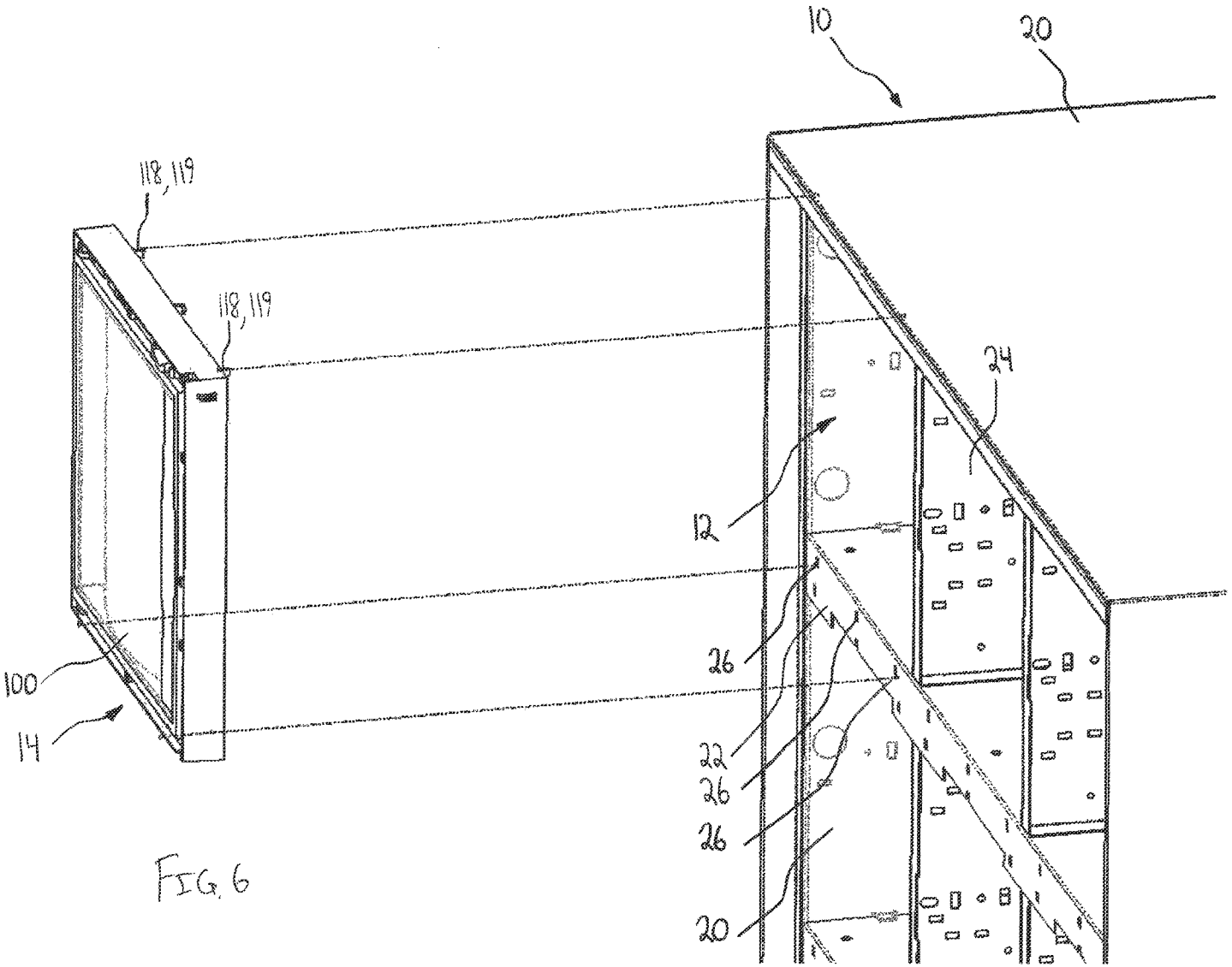
FIG. 6 is a front perspective view of the of door assembly of FIGS. 4 and 5, exploded away from the front frame of a storage or dispensing unit.

Referring to FIGS. 5 and 6, in one embodiment the rearwardly-projecting fingers 118 of the frame 110 are configured to engage the locking mechanism 140 and couple the locking mechanism 140 to the frame 110. In another embodiment, the locking mechanism 140 may include or be coupled to a back plate 147 having similar resilient fingers 148 carrying triangular ramps 149 adapted to lockingly engage within apertures 111 on the frame 110, such as the intermediate web 115. The locking mechanism 140 may thus be retained within the rear-facing channel portion 114" through a form of snap-fit engagement. However, the locking mechanism 140 can be positioned in the front-facing channel 114 and secured in place by any of a variety of others means or devices, such as by adhesives, fasteners, etc.

The door controller 142 may be electrically coupled to the storage assembly controller 16 via control wiring 180 (shown in FIG. 8). In this manner the controller 16 may control the operation and status of each locking mechanism 140 associated with each door 100. The door controller 142 for each locking mechanism 140 may be networked to the controller 16 through an analog addressable or digitally addressable bus electrically distributed through the control wiring 180.

As indicated above, control wiring 180 is routed across the front face of the storage assembly 10 by placing the control wiring 180 in the front-facing channels 114. The control wiring 180 may extend from the front-facing channel 114 of one door frame 110 to a vertically adjacent door frame 110 via the front-facing slots 116. In one case, then, the control wiring 180 is positioned at or adjacent to the front of the storage assembly 10 across the entire front thereof, such that all control wiring 180 is in a front-facing channel 114 and recessed away from the front face until the control wiring reaches an outer perimeter of the front, where it can be routed away to the controller 16. If it is desired to route the control wiring 180 to horizontally adjacent doors 100/door assemblies 14, the control wiring 180 may be routed vertically to the top and/or bottom edge of the front frame 22, where the control wiring 180 can be routed horizontally. Alternately, a door assembly 14 may include front-facing slots positioned on opposite ends (horizontal ends) of a channel extension 117 to provide access to a horizontally adjacent door assembly for the control wiring 180.

Thus, in contrast to many current wiring configurations, the front-facing channels 114 and front-facing slots of door assembly 14 are configured to receive control wiring 180 routed therethrough, and to the front-facing channel 114 of an adjacent door assembly 14. The front-facing channel 114 of one door assembly 14 may communicate with the channels of adjacent doors 100 and/or door assemblies 14 to enable the control wiring 180 to be routed to the various doors 100/200 door assemblies 14, and components thereof, and to the controller 16. In addition, the routing of the control wiring 180 can be done from the front side of the storage assembly 10, which provides ease of access for assembly, repair, or replacement of door assemblies 14 in a modular manner. In contrast, in many existing systems, such control wiring would extend between the walls of the internal compartments, which are difficult to access.

The locking mechanism 140 and other electrically powered components may be powered by the control wiring 180, which may take the form of a powered and addressable shared bus or networking cable, similar to devices powered using power-over-ethernet technology, or may be powered by separate power wiring 182 bundled with the control wiring 180.

Door controller 142 may operate the locking mechanism 140 and any other accessory components included in the door assembly 14. Door controller 142 may be programmed with a physical addresses which allows the controller 16 to individually address that specific door controller 142 and to operably control at least the associated locking mechanism 140. The physical address for each microcontroller 142 may be unique at least with respect to the storage assembly 10 like, for example, an ethernet MAC address, and may be globally unique like, for example, a so-called "silicon serial number" (e.g., products by Maxim Integrated, Inc., San Jose, Calif., USA) or a non-volatilely programmed GUID.

In one embodiment, the controller 16 may be programmed with the physical address of each door controller 142. In another embodiment, the controller 16 may learn the physical address of each door controller 142 after connection of the microcontroller 142 to the control wiring 180 through an announce-and-respond process. In such a process, controller 16 may broadcast an initialization announcement, and door controllers 142 may respond after a randomized delay period with their physical address. Controller 16 may store the physical addresses, or acknowledge one or more responses (usually, a first response) by transmitting an assigned network address to the responding door controller(s) 142. Controller 16 may repeat the initialization announcement, and door controllers 142 that have not been assigned a network address may again respond after a randomized response delay period, during a plurality of process iterations, stopping after a predetermined number of iterations or once no more responses are received. In an alternate process, door controllers 142 may broadcast, after a randomized delay period, an initialization announcement including their physical address. Controller 16 may store and acknowledge receipt of the physical addresses or respond to the broadcast physical addresses by transmitting assigned network addresses. Door controllers 142 may continue to broadcast such initialization announcements until they have received an acknowledgement or assigned network address.

Door assemblies 14 may include a door state sensor 150 which may signal whether the door 100 is closed or open or whether the door state has changed. For example, door state sensor 150 may be a magnetic switch, optical switch, or Hall effect sensor positioned adjacent to the door 100 which directly signals whether the door is closed or open. For further example, door state sensor 150 may be a magnetic switch, optical switch, or Hall effect sensor positioned adjacent the locking projection 146 which indirectly signals whether the door 100 has been closed by sensing a displacement of the locking projection 146 during closing of the door similar to that seen in a spring bolt lock.

The door state sensor 150 and addressable door controller 142 may then be used to associate a physical location of the door 100 upon the storage assembly 10, or a human-readable door identifier associated with the door 100, with the controller 16. For example, in embodiments where doors 100 are spring-biased toward an open position, controller 16 may signal the door controllers 142 of the door assemblies 14 to unlock each of the doors 100. The doors 100 may then be closed in an expected order, e.g., left-to-right, top-to-bottom or in order of the identifiers, as the case may be, to associate the door 100 and corresponding internal compartment 12 with a physical location plan or identifier scheme in controller 16 (by signaling, through door state sensor 150 and door controller 142 to controller 16, an expected change in door state).

A user may later select a desired door 100 and/or internal compartment 12 using the user interface 18, with controller 16 signaling through the appropriate door controller 142 actuation of the locking mechanism 146 to release the appropriate door 100. The physical and/or network addresses, physical location plan and/or identifier scheme, and associations may be retained in a non-volatile storage memory so that storage assembly 10 may be inventoried, shipped, and/or restored to service from an unpowered state without breaking the configured associations. The storage assembly 10 could of course be reprogrammed during service to replace a door assembly 14, to reconfigure the storage assembly 10 using different partitions 24 and door assemblies 14, etc.

The front-facing channel 114 and/or rear-facing channel portion 114" may also be configured to receive and retain other cooperating/accessory components, such as a light assembly 161 configured to selectively illuminate a compartment 12. The light assembly 161 may include a daughterboard 163, which carries thereon a plurality of indicator lights 160 and a longitudinally extending compartment illumination light 170. In the illustrated embodiment the light assembly 161 extends generally horizontally and may be positioned in the horizontally extending channel extension 117 of the channel 114. The light assembly 161 may be electrically connected to the locking mechanism 140 (and, ultimately, to the controller 16) via cooperating wiring connectors or electrical contacts 162 provided on daughterboard 163 of the light assembly 161 and on the daughterboard 141 of the locking mechanism 140 (see FIGS. 4 and 5). Alternately, rather than being positioned in the channel extension 117, the light assembly 161 could be co-mounted with the locking mechanism 140 in the front-facing channel 114.

In one embodiment, the light assembly 161 may include or be coupled to a back plate 167 having forwardly-extending resilient fingers 168 carrying triangular ramps 169 adapted to lockingly engage apertures 111 (shown in FIG. 8) of the frame 110, such as on the intermediate web 115. The light assembly 161 may thus be mounted and retained via a snap-fit engagement. Alternately or in addition, the rear-facing channel 114" may include a plurality of rearwardly-projecting resilient fingers 118 adapted and positioned and lockingly retain the light assembly 161. The light assembly 161 may be further alternately be affixed to a the door frame 110 by adhesives, fasteners, or other known means or devices.

The door assembly 14 may include an indicator light guide 164 (FIG. 4) configured to be mounted adjacent to the indicator lights 160 to direct light to front of the fascia 15 so that a user can view light emitted by the indicator light 160. The fascia 15 may accordingly be provided with a transparent window (not shown) or an aperture corresponding to a projecting portion of the light guide 164 to allow viewing of the emitted light from the front of the dispensing device 10. The operation of the indicator lights 160 may be controlled by the controller 16. Thus, some or all of the indicator light 160 may be turned on and/or off, in various combinations, when the associated door 100 is opened, closed, locked or unlocked to communicate such information to the user.

The compartment illumination light 170 may be positioned within the channel 114 and/or the channel extension 117 and configured and positioned to direct visible light into the associated internal compartment 12 and/or externally of the compartment. In one embodiment the compartment illumination light 170 may be mounted on or positioned within the back plate 167, which may include a transparent or translucent light cover 165 to cover and protect the compartment illumination light 170. In other embodiments, such as in cases where the back plate 167 is not utilized, the compartment illumination light 170 may be co-mounted with the indicator light 160, i.e., on an opposite side of the daughterboard 163, or mounted on a separate structure retained within the channel 114, i.e., a separate daughterboard. In such cases the compartment illumination light 170 may be may be electrically connected to electrical header 143 and/or door controller 142 through wiring connectors or electrical contacts provided on respective portions of the compartment illumination light 170 and locking mechanism 140, either directly or through the indicator light 160.

The operation of the compartment illumination light 170 may be controlled by the controller 16. Thus, the compartment illumination light 170 may be turned on and/or off when the associated door 100 is opened or unlocked to aid a user in viewing inside the internal compartment 12 and/or to signal to the user which doors 100/compartments 12 the user is authorized to access.

Figure 9:
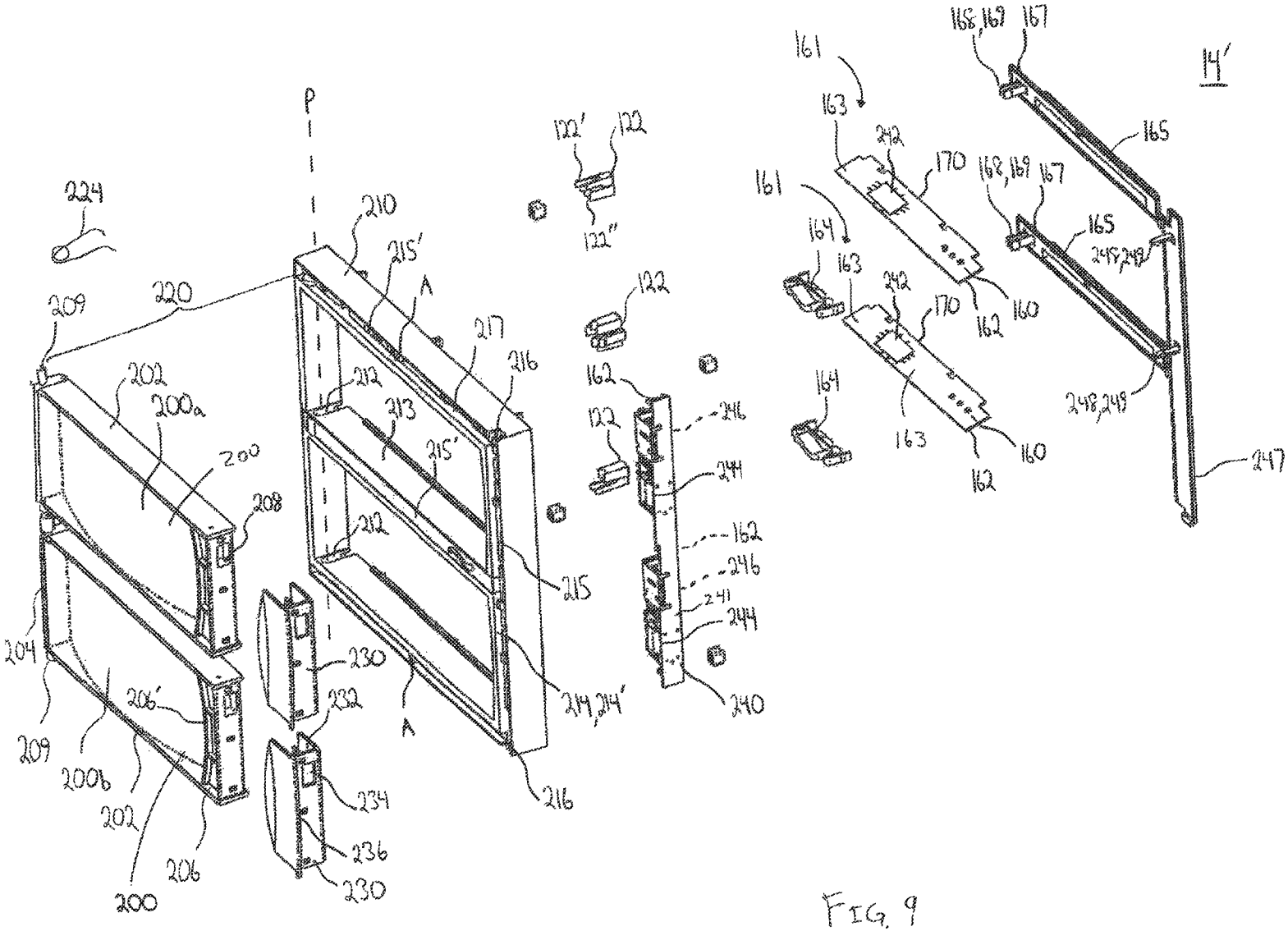
FIG. 9 is an exploded front perspective view of an alternate door assembly.
Figure 10:
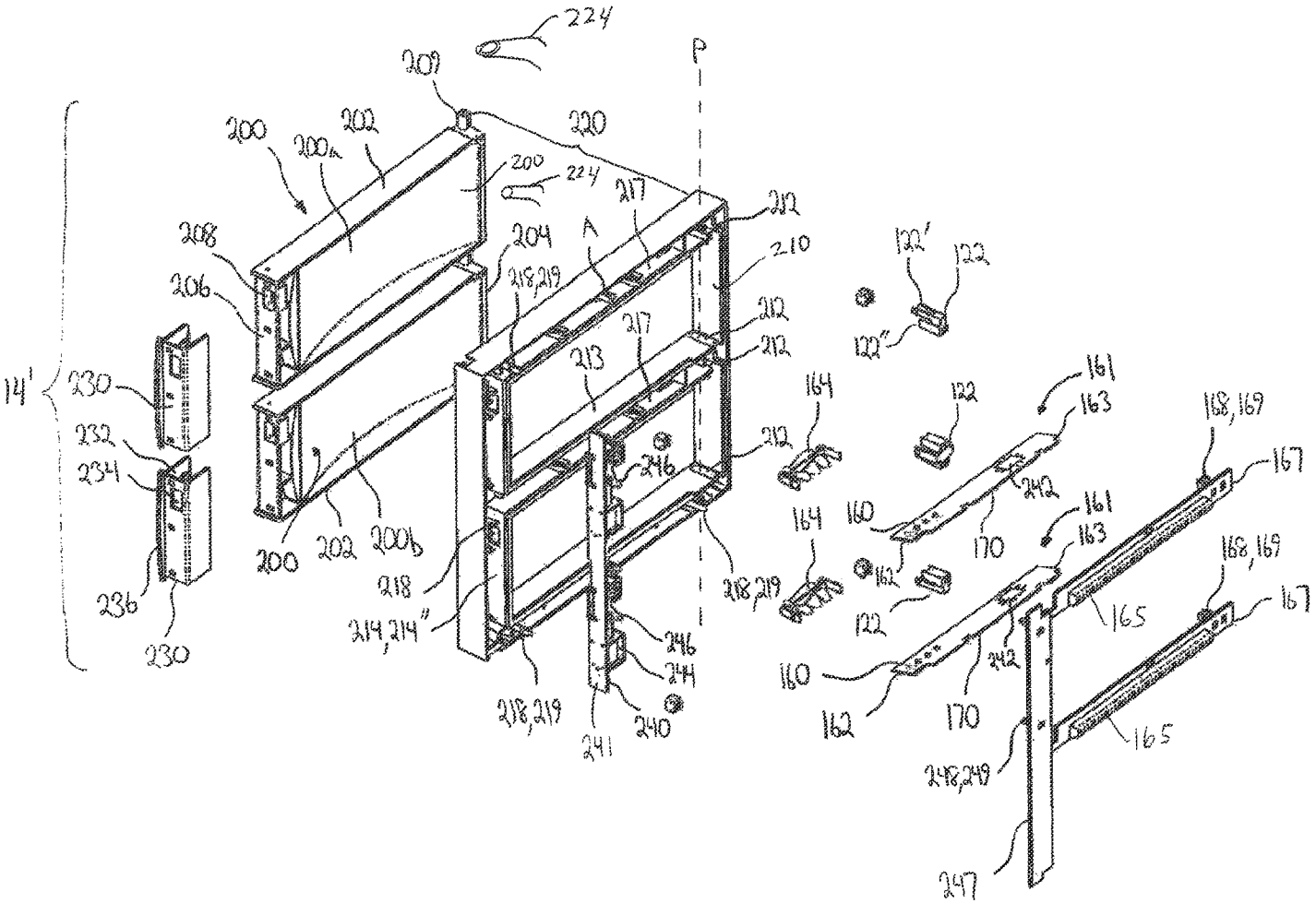
FIG. 10 is an exploded rear perspective view of the door assembly of FIG. 9.
Figure 11:
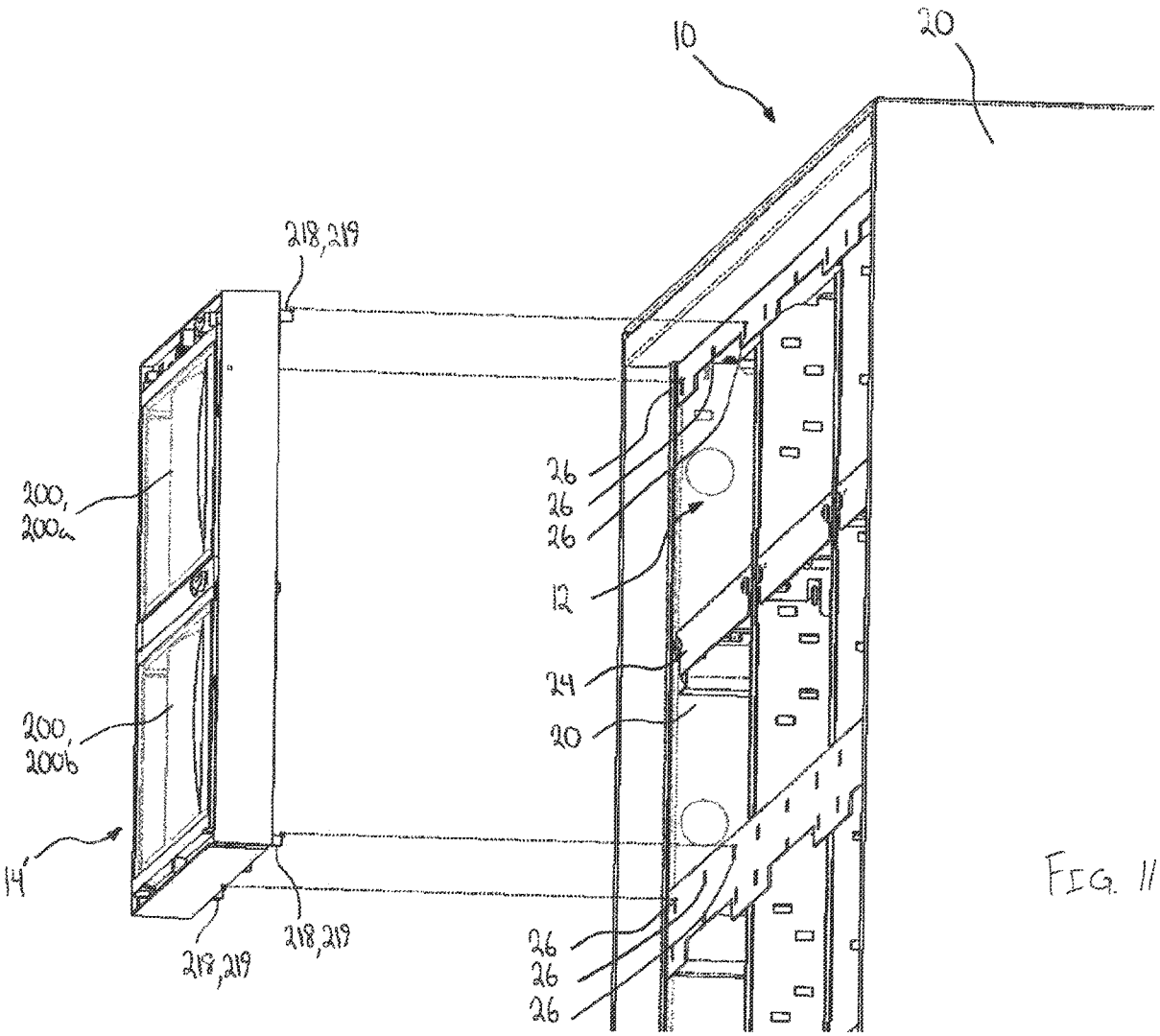
FIG. 11 is a front perspective view of the door assembly of FIGS. 9 and 10, exploded away from the front frame of a storage or dispensing unit.

FIGS. 9 and 10 illustrate a second embodiment of a front-mounted door assembly 14', which in this case includes a plurality of aligned doors 200 having a common pivot axis P. The door assembly 14' includes a door frame 210 extending about the entire perimeter of each of the plurality of doors 200. Each door 200 has a pivoting connection 220 between the individual door 200*a*, 200*b*, etc. and the door frame 210 adjacent a proximal end of the door 200 (including a pivoting connection to at least one cross member 213, as discussed further below), and a reinforcing handle 230 positioned at a distal end of the door 200*a*, 200*b*. As in the first embodiment, the doors 200 can be comprised of a resilient and optically transparent material such as plastic, and may optionally include stiffening strips 202 formed in or affixed along the sides between the pivoting connection 220 and the reinforcing handle 230. Each door 200 may also include a stiffening strip 204 formed in or affixed along the proximal end of the door adjacent the axis P.

Each door 200 may further include a handle mount 206 at its distal end for receiving and retaining the associated reinforcing handle 230. The reinforcing handles 230 may be coupled to the handle mounts 206 in the same manner as outlined above for the reinforcing handle 130 and handle mount 106. The handle mount 206 may be include a lock aperture 208 configured and positioned to receive a locking projection 246 of a locking mechanism 240, and an arcuately profiled internal portion 206' in the same manner as the internal portion 106' outlined above.

The pivoting connection 220 between door 200*a*, 200*b*, etc. and door frame 210 may take the form of a pair of oppositely projecting pivots 209 positioned on the outer perimeter of the door 200 and received in a pair of slots 212 formed in the corresponding locations of the frame 210. Except for the use of two doors 200*a*, 200*b*, and other differences noted herein and shown in the drawings, the door assemblies 14' of FIGS. 8 and 9 are formed, assembled, and operate in generally the same manner as the door assemblies 14 as outlined above, and therefore the full details are not reproduced herein. The reference numbers used in the embodiments described above are utilized in FIGS. 9 and 10, but in some cases with the prefix "2" in front of the remainder of the number.

The locking mechanism 240 in the embodiment of FIGS. 9 and 10 may differ by including a plurality of door controllers 242, each independently and operably controlling one of a plurality of solenoids 244 for a multiple-door assembly 14'. Alternately, a single door controller 242, configured to independently and operably control multiple locking mechanisms 240, may be used, however this alternative may require more complex signaling and potentially greater part costs. The microcontroller(s) 242 may be electrically connected to control wiring 180 in the same manner discussed described above to provide a wired connection to the controller 16. However, where a single door controller 242 is used the wiring may be further simplified through connection of the control wiring 180 to a single electrical header 243 to control the multiple doors 200*a*, 200*b*, etc. in the multiple-door assembly 14'.

In one embodiment of the single door controller alternative, each door controller 242 may be provided with a single physical address which allows the controller 16 to address the controller 242 and cause individual operation of the solenoids 242 of the locking mechanism 240. In such an embodiment, the controller 16 would be programmed to recognize that the door controller 242 may control more than one door and to determine the number of doors in the plurality of doors 200 through, e.g., a physical address range (identifying door assemblies 14 having one, two, or more doors), an announce-and-response exchange, etc. In another embodiment, each door controller 242 may be provided with a plurality of addresses which allow the controller 16 to address the door controller 242 as if it were multiple separate controllers, i.e., 'virtual' controllers, individually and operably controlling individual solenoids 244 of the locking mechanism 240. Thus, door controller 242 could function, and controller 16 may logically behave, as if the multiple-door assembly 14' of the embodiment of FIGS. 9 and 10 were a plurality of single door assemblies of the first embodiment.

In the illustrated embodiment each door assembly 14' includes two doors 200*a*, 200*b* positioned one on top of the other. However, it should be understood that the door assembly 14' may include more than two doors 200 stacked vertically, or two or more doors positioned in horizontal adjacency, or combinations of vertically and horizontally arrayed doors in various array lengths. The accessory components, control wiring 180, and microcontrollers 242 may be adjusted as necessary to accommodate the number and arrangement of doors 200.

Referring to FIGS. 1, 2A, 3A, a facia 15, or multiple facias 15, can be secured to the front frame 22 of the storage assembly 10. The facia 15 can extend around each door assembly 14, 14', and cover, or substantially cover, the front facing channels 114, 214 to provide a finished appearance to the storage assembly 10. In one embodiment, each fascia 15 may be secured to an the front frame 22 via fasteners passed through aperture A of a door assembly 14, 14' (FIGS. 4 and 8) and/or through apertures 26 of the front frame 22 (FIG. 8). For further example, a fascia 15 may be secured to an aperture 26 of the front frame 22 positioned in the interstitial space between adjacent door assemblies 14. In an alternate example, a fascia 15 may be secured to a the front fame 22 by passing fasteners through apertures A of each door assembly 14 which are aligned with apertures 26 of the front frame 22.

If desired, each fascia 15 can be secured to the front frame 22 using secure or one-way fasteners, such as a security torx screws, pentalobe screws or the like. Use of the security fasteners may provide a fastening device that is removable, but only with tools that are not commonly available. Alternately, a one-way fastener, such as a slot head screw with cammed ramps in the reverse direction, may be used.

Figure 12:
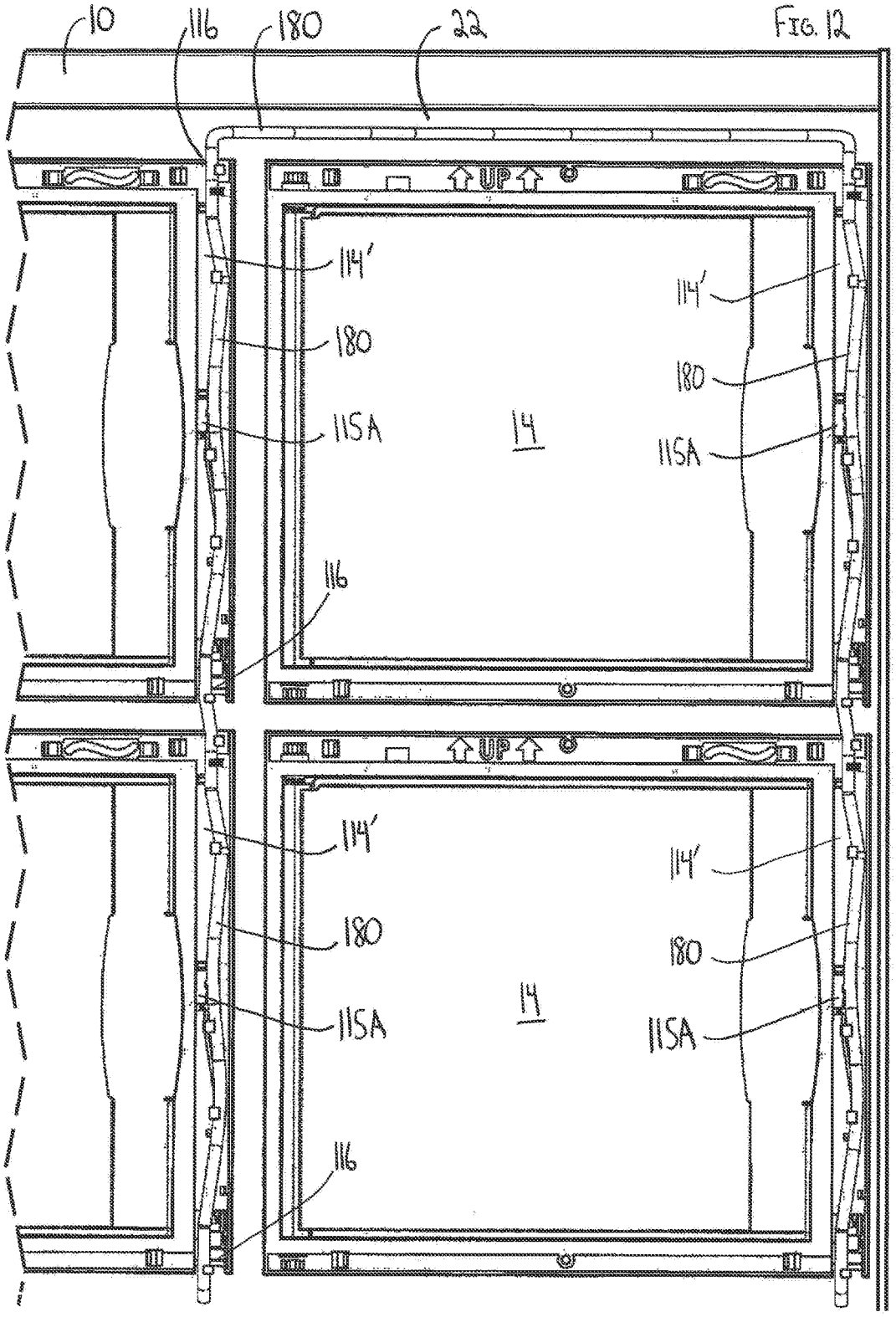
FIG. 12 is a schematic representation of a channel with control wiring positioned therein.

The system described and shown herein thereby provides ease of manufacture, access and repair. In particular, each door assembly 14 can be mounted in a modular manner, such as via a snap-fit, to the frame 20. Each door assembly 14 can include front-facing channels 114, 214 which provide a convenient channel in which control wiring 180 can be positioned. As shown in FIG. 12, the channels 114 of one door assembly 14, 14' may communicate with the channels of adjacent door assemblies 14, 14' to enable the control wiring 180 to be routed to the various doors 100/200 and/or door assemblies 14, 14', and components thereof, and to the controller 16. The fascia 15 (shown in FIG. 2A) can be secured mounted to the frame 20 to prevent tampering, but may be able to be easily removed by authorized personnel. After removal of the fascia 15 the channels 114 provide ease of access to the control wiring 180. The channels 114 also provide ease of access during manufacture/assembly. In addition, the configuration of the storage assembly 10 could be comparatively easily reconfigured in the field. In particular partitions 24 can be added and/or removed as desired. Door assemblies 14, 14' that are no longer properly configured can be removed, and new, properly configured door assemblies 14, 14' can be mounted to the frame in the manner outlined above.

Although the invention is shown and described with respect to certain embodiments, it should be clear that modifications will occur to those skilled in the art upon reading and understanding the specification, and the present invention includes all such modifications.

What is claimed is:

1. A storage assembly comprising:

a frame at least partially defining a plurality of storage compartments that are accessible from a front of said storage assembly;

a plurality of doors, each door being associated with at least one storage compartment and movable between a closed position in which the door generally prevents access to the associated storage compartment and an open position in which the door allows access to the associated storage compartment; and a plurality of accessory components, each accessory component being operatively associated with at least one of said doors, each accessory component being operatively coupled to a controller via control wiring, and wherein said storage assembly includes a front-facing channel in which said control wiring is at least partially positioned.

2. The assembly of claim 1 wherein at least some of said accessory components are at least partially positioned in said front-facing channel.

3. The assembly of claim 1 wherein the frame has a generally planar front face, and wherein the front-facing channel extends generally parallel to said front face, and is open to said front of said storage assembly and generally closed on other sides thereof.

4. The assembly of claim 1 wherein said storage assembly includes a plurality of supplemental front-facing channels extending thereacross, and wherein at least some of said front-facing channels are in direct communication with each other to allow control wiring to be routed from one front-facing channel to another front-facing channel.

5. The assembly of claim 1 wherein said control wiring is positioned at or adjacent to said front of said storage assembly and from the plurality of accessory components across the front of the storage assembly within the front-facing channel until said control wiring reaches an outer perimeter of the front of said frame.

6. The assembly of claim 1 further comprising a fascia removably mounted to said frame, said fascia generally covering and closing off said front-facing channel upon assembly to said frame.

7. The assembly of claim 1 wherein at least one of said accessory components is a supplemental controller, or a solenoid, or a locking mechanism, or a sensor, or a light.

8. The assembly of claim 1 wherein at least one of said doors is pivotally movable between said closed and open positions, and wherein at least one of said accessory components takes the form of a lock assembly associated with said at least one door, said lock assembly being movable between a locked position in which said lock assembly locks the associated door in place and an unlocked position in which said lock assembly does not lock the associated door in place, wherein the assembly further includes said controller, wherein said controller is mounted on said frame and operatively coupled to said lock assembly to control the locked or unlocked state of said lock assembly.

9. The assembly of claim 8 wherein said lock assembly is positioned in said front-facing channel.

10. The assembly of claim 8 wherein said control wiring is operatively coupled to said lock assembly.

11. The assembly of claim 1 further comprising a plurality of door assemblies, each door assembly including one of said doors and at least one of said accessory components, wherein each door assembly is removably attachable to said frame.

12. The assembly of claim 11 further comprising said controller which is coupled to said frame, and wherein each accessory component is operatively detachably coupled to said controller.

13. The assembly of claim 11 wherein each door assembly includes at least part of said front-facing channel.

14. A storage assembly comprising:

a frame at least partially defining a plurality of storage compartments; and a plurality of door assemblies, each door assembly including at least one accessory component and at least one door associated with at least one storage compartment, wherein each door is movable between a closed position in which said door generally prevents access to the associated storage compartment and an open position in which said door allows access to the associated storage compartment, wherein said accessory components are electrically operated, operatively associated with one of said doors, and operatively connectable to a storage assembly controller via control wiring, wherein each door assembly includes a front-facing channel in which said control wiring is at least partially positionable, and a control wiring connector is received, for connection between the at least one accessory component and said storage assembly controller, and wherein each door assembly is removably attachable to said frame.

15. The assembly of claim 14 wherein each door assembly includes a door controller coupled to a door assembly frame with the at least one accessory component operatively connected to said door controller, and wherein each door controller is operatively connectable to and individually addressable by said storage assembly controller via the control wiring.

16. The assembly of claim 14 wherein each accessory component is directly coupled to the associated door assembly, and not directly coupled to the frame.

17. The assembly of claim 14 wherein each respective front-facing channel includes a pair of front-facing slots positioned on opposite ends of the respective front-facing channel, and the control wiring is routable between the front-facing channels of adjacent door assemblies via adjacent front-facing slots.

* * * * *